US007673952B2

(12) United States Patent
Jeansonne et al.

(10) Patent No.: US 7,673,952 B2
(45) Date of Patent: Mar. 9, 2010

(54) MEDICAL TREATMENT CART

(76) Inventors: Gordon Bud Jeansonne, 135 N. Madison St., Orange, VA (US) 22960; Maureen Gallagher, 135 N. Madison St., Orange, VA (US) 22960

( * ) Notice: Subject to any disclaimer, the term of this patent is extended or adjusted under 35 U.S.C. 154(b) by 821 days.

(21) Appl. No.: 11/452,198

(22) Filed: Jun. 14, 2006

(65) Prior Publication Data

US 2007/0290587 A1 Dec. 20, 2007

(51) Int. Cl.
*B01L 9/02* (2006.01)

(52) U.S. Cl. ..... 312/209; 312/287; 312/249.11

(58) Field of Classification Search ..... 312/209, 312/249.11, 287, 311, 348.3, 283
See application file for complete search history.

(56) References Cited

U.S. PATENT DOCUMENTS

| | | | | | |
|---|---|---|---|---|---|
| 2,209,294 | A | * | 7/1940 | Froelich | 312/209 |
| 3,715,148 | A | * | 2/1973 | Beals | 312/209 |
| 3,834,778 | A | | 9/1974 | Morrison et al. | |
| 3,969,006 | A | | 7/1976 | Brown | |
| 4,588,237 | A | * | 5/1986 | Marder | 312/209 |
| 4,652,062 | A | | 3/1987 | Greenwood | |
| 4,875,696 | A | | 10/1989 | Welch et al. | |
| 5,069,511 | A | * | 12/1991 | Swets et al. | 312/107.5 |
| 5,290,058 | A | | 3/1994 | Adams et al. | |
| 5,702,115 | A | | 12/1997 | Pool | |
| 5,743,607 | A | * | 4/1998 | Teufel et al. | 312/265.2 |
| 5,765,842 | A | * | 6/1998 | Phaneuf et al. | 280/47.35 |
| 5,905,653 | A | * | 5/1999 | Higham et al. | 700/244 |
| 5,915,803 | A | * | 6/1999 | Daugherty et al. | 312/263 |
| 6,663,202 | B2 | | 12/2003 | Spann | |
| 6,820,878 | B2 | | 11/2004 | Safari et al. | |
| 7,044,569 | B1 | * | 5/2006 | Relyea et al. | 312/249.11 |
| 2001/0008984 | A1 | * | 7/2001 | Omura et al. | 700/241 |
| 2002/0070847 | A1 | * | 6/2002 | Hamilton et al. | 340/309.15 |
| 2005/0159784 | A1 | | 7/2005 | Arceta | |
| 2005/0236940 | A1 | | 10/2005 | Rockoff | |

FOREIGN PATENT DOCUMENTS

| | | | | |
|---|---|---|---|---|
| CH | 671508 | * | 9/1989 | 312/209 |
| DE | 3917875 | * | 6/1990 | 312/209 |

* cited by examiner

*Primary Examiner*—Hanh V Tran
(74) *Attorney, Agent, or Firm*—Miles & Stockbridge P.C.; David R. Schaffer, Esq.

(57) ABSTRACT

A medical treatment cart includes two compartments, each housing five individually slidable drawers which can be closed and locked by vertically pivoted doors in turn carrying individual and distinct locking mechanisms, such as different keys for associated locks or different combinations for combination locks. At least some of the drawers include patient baskets containing appropriate treatment supplies and medications with each patient basket being identified by name and room number with all odd numbered patient rooms being located on one side of the medical treatment cart and all even numbered patient rooms being located on another side of the medical treatment cart. Preferably, two nurses or like caregivers utilize opposite sides of the medical treatment cart to treat patients on opposite sides of the corridor in a typical medical facility.

18 Claims, 3 Drawing Sheets

MEDICAL TREATMENT CART

BACKGROUND OF THE INVENTION

The invention is directed to a wheeled medical treatment cart which can be utilized in hospitals, nursing homes or like medical facilities by nurses or similar healthcare providers for treating patients who normally reside in rooms on opposite sides of a corridor within the medical facility.

Typical medical treatment carts are disclosed in the below-listed United States publications and patents:

| | |
|---|---|
| 3,834,778 | Morrison et al. |
| 3,969,006 | Brown |
| 4,652,062 | Greenwood |
| 4,875,696 | Welch et al. |
| 5,290,058 | Adams et al. |
| 5,702,115 | Pool |
| 5,765,842 | Phaneuf et al. |
| 6,663,202 B2 | Spann |
| 6,820,878 B2 | Safari et al. |
| 2005/0159784 A1 | Arcreta |
| 2005/0236940 A1 | Rockoff |

As one example of a transportable medical treatment cart, in U.S. Pat. No. 6,663,202 granted to James P. Spann, reference is made to medical treatment carts which have drawers for holding medical supplies needed for a particular medical procedure and in describing related prior art mention is made of structural ability, slideable drawers, a large upper support surface, side extensions and the like with references being made to a dozen different patents.

Somewhat more germane to the invention disclosed herein is U.S. Pat. No. 3,834,778 issued to Robert B. Morrison which discloses a nurse's cabinet cart having a plastic liner tray with integral raised and spaced ribs for supporting individual patient medicine trays, as well as a hypodermic needle tray. The purpose is to assure that a nurse's time and accuracy in presenting the proper medicine to the proper patient occurs each time and without touching the pills or other medicines of another patient.

U.S. Pat. No. 4,652,062 granted to Sidney Greenwood discloses a cart particularly designed for responding to emergencies and includes an interior housing a plurality of shelves which can be closed by a pair of doors mounted for pivotal movement on vertical axes and which are capable of being locked to each other to prevent access to the interior shelves and the products housed thereon.

BRIEF SUMMARY OF THE INVENTION

In keeping with the forgoing, a primary object of the present invention is to provide a novel medical treatment cart which includes a housing which defines a chamber with a central wall dividing the chamber into back-to-back separate individual first and second compartments each accessible from an opposite side of the cart. Each compartment includes a plurality of vertically disposed horizontally slidable drawers which are partitioned to house baskets in each of which supplies/medications are housed for a specific patient. In the closed position, the drawers are covered by pivoted doors which are locked in the closed position thereof by either different locks or different combinations associated with locks on opposite sides of the medical treatment cart. Typically, as the medical treatment cart is pushed down the corridor in a hospital, nursing home or a similar health-provider facility, odd and even numbered rooms are normally located on opposite sides of the corridor. By appropriately providing the baskets with the patient's name and room number, odd room numbers are located on one side of the medical treatment cart and even room numbers are located on an opposite side of the medical treatment cart. Therefore, simply by utilizing the latter arrangement, a fifty percent (50%) reduction in error will occur because automatically odd and even baskets will be utilized only with respect to odd and even patient room numbers and the patients administered therein.

In further accordance with the invention, not only are the baskets on opposite sides of the medical treatment cart appropriately correctly numbered with odd and even numbers and the names of the patients associated with the rooms, but lockable doors in the closed position cover the drawers housing the patient baskets and prevent the drawers from being opened unless the doors are opened utilizing a key or a combination which on the one hand will only open the door covering the drawers carrying the even numbered basket room numbers while another set of doors similarly cover and lock the drawers containing the odd numbered basket room numbers. By utilizing different keys, namely, an odd opening door key and an even opening door key and preferably utilizing two nurses or like health providers simultaneously treating patients from one and only one side (odd or even) of the medical treatment cart and maintaining control of the keys (combinations) assigned thereto, dosing and medication mishandling is further reduced. Moreover, this added control places direct responsibility upon the attendant for his/her side of the medical treatment cart and there is thereby established a direct patient responsibility at the drawers, the associated basket contents and the doors associated therewith so as to be closed and locked when, for example, the medical treatment cart is left unattended in the passageway or corridor and the nurse or other health provider is treating the designated patient. In this relatively straightforward manner there is virtually a guaranteed one hundred percent (100%) assurance that all patients will be treated only in the manner specified and only using the specific patient's prescribed medication.

With the above and other objects in view that will hereinafter appear, the nature of the invention will be more clearly understood by reference to the following detailed description, the appended claims and the several views illustrated in the accompanying drawings.

DETAILED DESCRIPTION OF THE PREFERRED EMBODIMENTS

Figure 1:
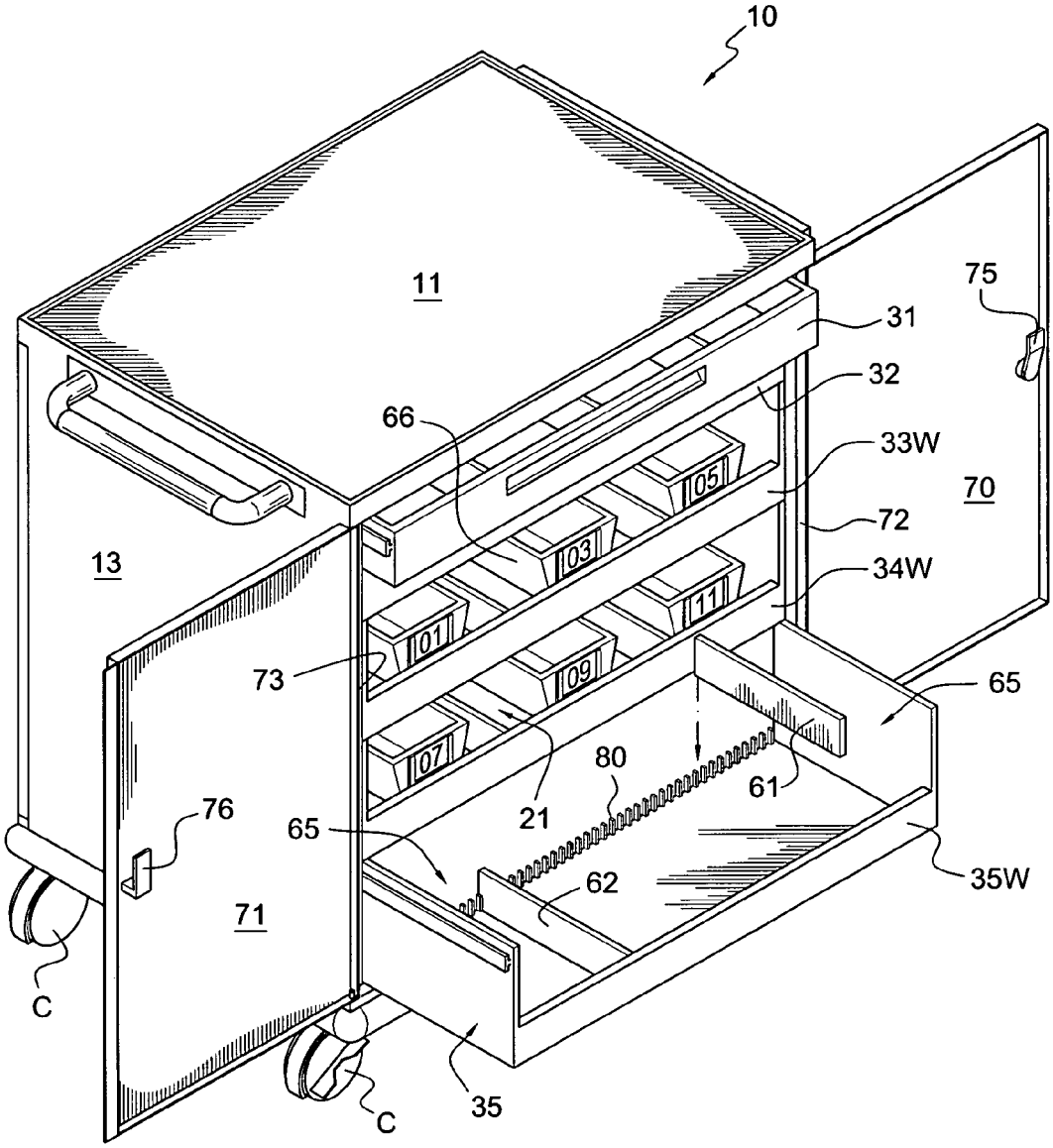
FIG. 1 is a front perspective view of a novel medical treatment cart of the present invention, and illustrates one of two compartments, five horizontally slidable drawers associated with the compartments, two vertically pivotal doors for closing the compartment in its closed position, and a locking mechanism for locking the doors in the closed position thereof.
Figure 2:
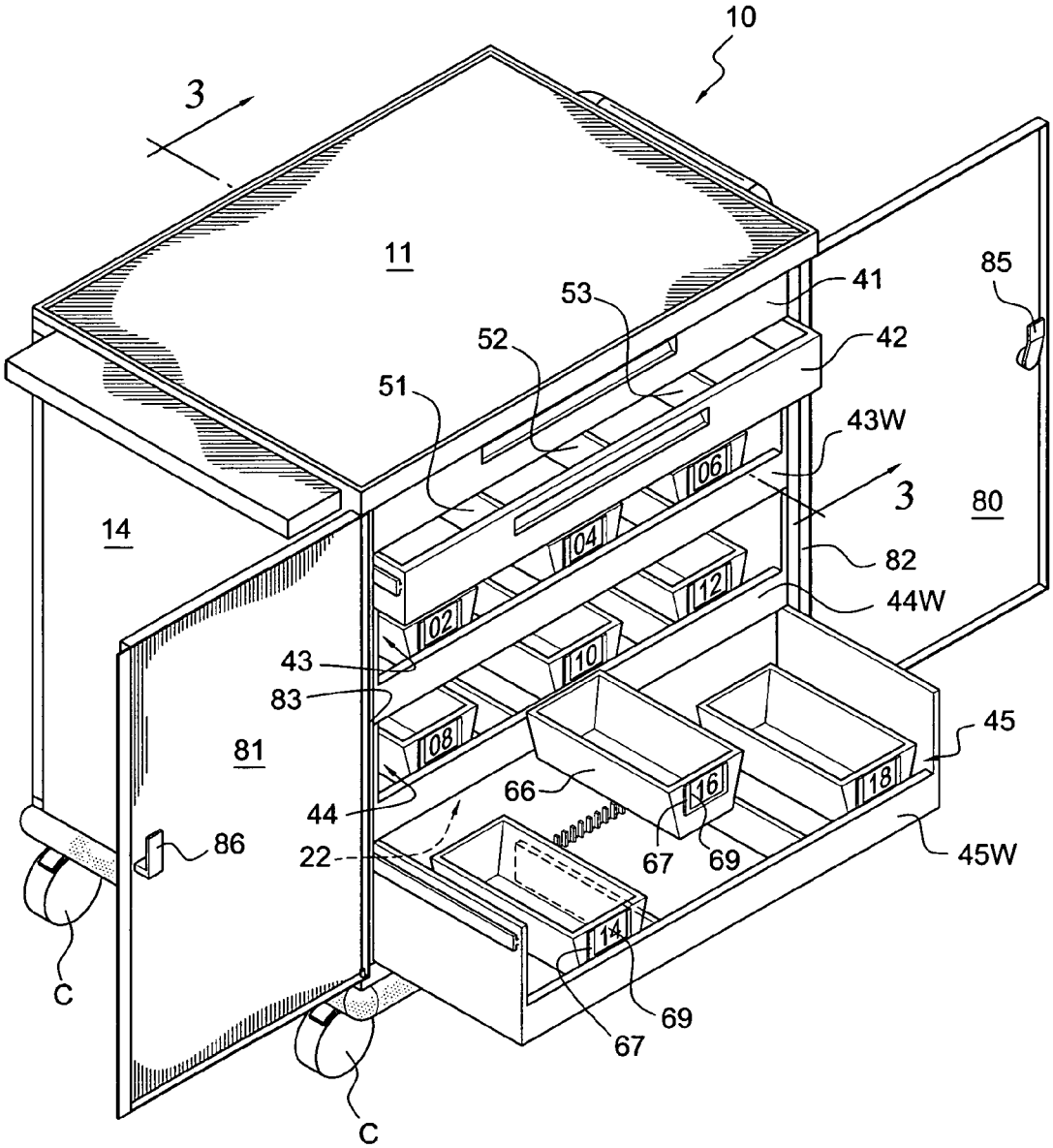
FIG. 2 is a rear perspective view of the medical treatment cart of FIG. 1, and illustrates two drawers partially slid outwardly to an open position and partitions in the lower drawer defining basket-receiving compartments, patient baskets associated therewith, and a cooperative locking mechanism for locking the doors in a closed position thereof.
Figure 3:
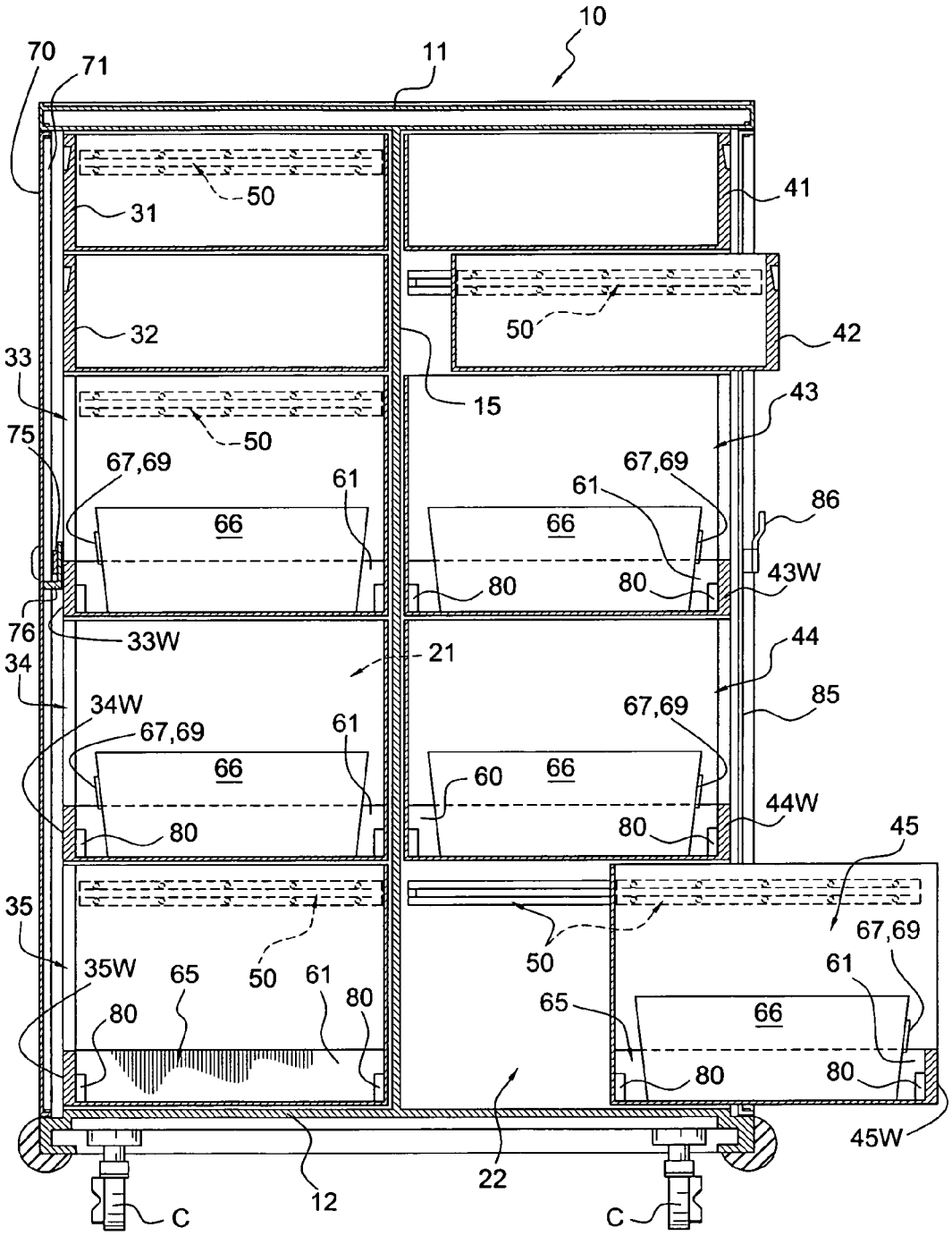
FIG. 3 is a cross-sectional view taken generally along line 3-3 of FIG. 2, and illustrates a vertical central partition or wall dividing the medical treatment cart housing into back-to-back separate individual first and second compartments each housing horizontally sliding drawers and each held closed by individual vertically pivoted doors locked to each other by different locks to prevent cross access or inadvertent access thereto.

A novel medical treatment cart constructed in accordance with this invention if fully illustrated in FIGS. 1 through 3 of the drawings and is generally designated by the reference numeral 10.

The medical treatment cart 10 includes a housing or chamber (unnumbered) defined by a top wall 11, a bottom wall 12 (FIG. 3) a front wall 13, a rear wall 14 and means 15 (FIG. 3) in the form of a central wall or partition integral with and extending between the top and bottom walls 11, 12, respectively, for dividing the housing or chamber into back-to-back separate individual first and second compartments 21, 22, respectively.

A first plurality of five vertically disposed horizontally slidable drawers 31 through 35 are located in the first compartment 21 while a second plurality of five vertically disposed horizontally slidable drawers 41 through 45 are located in the second compartment 22 with the vertical wall 15 (FIG. 3) and the front and rear walls 13, 14, respectively, separating the two compartments 21, 22.

Each drawer 31 through 35 and 41 through 45 includes conventional roller bearing slides 50 for facilitating the sliding movement of the drawers 31-35 and 41-45 between the fully closed and opened positions thereof.

The two uppermost drawers 31, 32 and 41, 42 are each a storage drawer and each storage drawer is approximately 4 inches in height, 24 inches in depth, 36 inches in length, and each includes three adjustable dividers 51 through 53 (FIG. 2) which can divide each of the upper storage drawers 31, 32, 41 and 42 into a maximum of four compartments or can be individually or completely removed as circumstances dictate. The drawers 33 through 35 and 43 through 45 are patient basket drawers and each patient basket drawer is divided into three basket compartments 65 by two parallel partitions 61, 62 which extend normal to the divider wall 15. Each basket drawer 33 through 35 and 43 through 45 is thereby divided into three individual basket compartments 65. While the height of each of the basket drawers 33 through 35 and 43 through 45 is approximately 9 inches, the height of respective front walls 33*w* through 35*w* and 43*w* through 45*w* and the height of the partitions 61 and 62 is approximately 2-½ inches to provide easy access for the insertion and the withdrawal of patient baskets 66 from the individual basket compartments 65 (FIG. 2). Suitable conventional means (80) may be utilized to adjust the partitions 61, 62 relative to each other and relative to the basket drawers 33 through 35 and 43 through 45 to vary the size of each basket compartment 65, should such be desired.

Each individual patient basket 66 is preferably constructed of disposable plastic material and includes means 67 (FIG. 2) in the form of a slot for receiving an identification card 69 bearing thereon at least the patients name and room number. The lower height (2-½) inches of the basket drawer front walls 33*w* through 35*w* and 43*w* through 45*w* allow information on each identification card 69 to be easily read when any patient basket 65 is still in a drawer 33 through 35 and 43 through 45 irrespective of whether or not the drawer is pulled out of its associated compartment 21, 22 or not. Compare, for example, drawer 45 of FIG. 3 with the drawers 43 and 44 of FIG. 3. As was described earlier herein, patient baskets 66 accessible from one side of the treatment compartment 10 have therein only odd numbered patients room numbers, while patients basket 66 accessible from the opposite side of the medical treatment cart 10 have only even numbered patient room numbers thereon.

The front compartment 21 (FIG. 1) of the medical treatment cart 10, when all drawers 31 through 35 are closed, can then be completely closed by two doors 70, 71 which are each mounted for vertical pivoting movement about a respective vertical pivot or pivot pin 72, 73 for movement between the open position thereof (FIG. 1) and the closed position (FIG. 3). In a like manner, when the drawers 41 through 45 are completely closed, two doors 80, 81 (FIG. 2) mounted for hinging movement about respective vertical pivots or pivot pins 82, 83 permit the doors to the closed. Most importantly, the doors 70, 80 include locking means 75, 85, which latch/lock with locking lugs 76, 86 of the doors 71, 81, respectively, in a conventional manner to hold the doors 80, 81 locked. Most importantly, however, the lock associated with the locking means 75 is different than the lock associated with the locking means 85 and, therefore, whether by a different key or a different combination, whatever the locking mechanism involved can only lock and unlock one of the locking means 75, 85, not both.

Use of the Medical Treatment Cart

The medial treatment cart 10 is preferably utilized in conjunction with two nurses or medical attendants, though a single nurse or medical attendant can perform the desired treatment of patients along a corridor, hallway or passageway of a medical facility, such as a hospital, nursing home, etc. Two nurses or medical attendants are preferable with each being provided a key or combination or other locking means which will lock and unlock only one of the locking means 75, 85. Thus, in this fashion only one medical attendant will have access to and will be responsible for the medicines, materials and treatments associated with and contained in only the drawers 31 through 35 or only in the drawers 41through 45, respectively, and the patient baskets 66 associated therewith. Therefore, the drawers and/or patient baskets 66 associated therewith of the drawers 31 through 35 would include only odd numbered patient rooms, whereas the drawers and baskets 66 associated with the drawers 41 through 45 would include only even numbered patient rooms or vice-versa. Thus, only one nurse/medical attendant would be responsible for patients on one side of a hallway or passage way, while the other nurse/medical attendant would be responsible for patients on the opposite side of the hallway/passageway.

Obviously, a single nurse/medical attendant provided with both keys/combinations to the locking means 75, 85 could utilize the medical treatment cart 10, but additional care would have to be taken to make certain that cross-medication, so to speak, would not occur through personal vigilance, most notably by treating all of the patients in odd numbered rooms first and only thereafter the remaining patients in even numbered rooms second or vice-versa.

The medical treatment cart 10 is rolled freely upon the conventional castors C to the doorway of the patient's/resident's room or rooms and whether being treated by one or two nurses or the like, the physicians order is verified by checking the physicians order in a conventional treatment book (not shown). Thereupon the proper locking means 75, 85 is unlocked and the specific basket 66 is removed with the correct patient's name and room number appearing thereon with additional supplies as needed, such as scissors, a biohazard bag, pen, gloves, medirules, etc. being removed from the drawers 31, 32 or 41, 42. Since the medical treatment cart 10 may be left unattended in the hallway, the doors 70, 71 or 80, 81 must be locked before entering the patient's room. The conventional steps of wiping all nozzles, scissors, bottle tops, etc. with alcohol pledgets or disinfecting the patient's overbed table will not be considered, except to indicate that all procedures required to effect a clean field will normally be followed. The proper basket 66 with the patient's name and room number is then placed in an area for convenient usage and whatever items need be administered from the basket 66 are administered to the patient after which materials, such as old dressings, are placed in the bio-hazard bag. Other materials can simply be placed back in the basket 66. The basket 66 is returned to the medical treatment cart 10, the procedure documented in the treatment book and the procedure repeated for the next patient in the next room.

Drawers 31 and 41 typically might include 17-½"×24" under pads, small clear trash bags, small bio-hazard bags and disinfectant wipes.

Drawers 32 and 42 might typically include a box of gloves (sterile and non-sterile), tape, bandages, scissors, small and large zip lock bags, labels with resident/patient room number and name, disposable medirules, sterile cotton applicators, sterile tongue blades and cultrurettes.

Typical items to be placed in the individual resident/patient baskets 66 are 4×4's, tape, normal saline, sterile water, Kling, ointments, gels and creams, special bandages, tongue blades, irrigation syringes and needles and associated medications, liquid and pill form, dependent upon the specific physician written order.

Although a preferred embodiment of the invention has been specifically illustrated and described herein, it is to be understood that minor variations may be made in the apparatus without departing from the spirit and scope of the invention, as defined by the appended claims.

We claim:

1. A medical treatment cart comprising a housing defining a chamber, means for dividing said chamber into back-to-back separate individual first and second compartments, a first plurality of vertically disposed horizontally slidable drawers arranged in said first compartment for sliding movement toward and away from said dividing means, a second plurality of vertically disposed horizontally slidable drawers arranged in said second compartment for sliding movement toward and away from said dividing means, first set of doors and a second set of doors for closing and opening first and second openings of said first and second compartments, respectively, through which said first and second drawers respectively slide to effect opening and closing of said first and second drawers, said first and second sets of doors movable between first and second positions to respectively close and open said first and second openings, first and second means for locking said first and second sets of doors individually in the second closed positions thereof to prevent drawer access, and said first and second locking means include differing and distinct first and second locking mechanisms provided on said first and second sets of doors for preventing opening and closing of said first locking means by said second locking means and vice-versa thereby isolating access to said first and second compartments to only authorized respective first and second persons.

2. The medical treatment cart as defined in claim 1 including a plurality of individual supply containers associated with at least one of each of said first and second plurality of drawers.

3. The medical treatment cart as defined in claim 1 including means for partitioning at least one of each of said first and second plurality of drawers into a pair of drawer compartments.

4. The medical treatment cart as defined in claim 1 including means for partitioning at least one of each of said first and second plurality of drawers into a pair of drawer compartments, and at least one supply container in one of the pair of drawer compartments.

5. The medical treatment cart as defined in claim 1 including a plurality of individual supply containers associated with at least one of each of said first and second plurality of drawers, and each supply container includes means for effecting the identification of a specific individual patient.

6. The medical treatment cart as defined in claim 2 wherein each supply container includes means for effecting the identification of a specific individual patient.

7. The medical treatment cart as defined in claim 1 including a plurality of individual supply containers associated with at least one of each of said first and second plurality of drawers, each supply container includes means for effecting the identification of a specific individual patient, and said identification effecting means includes means in said at least one supply container for the reception of a patient identification card.

8. The medical treatment cart as defined in claim 2 wherein said first and second drawers each have relatively short front walls as compared to the height of said individual supply containers whereby the latter can be relatively easily inserted in and removed from said drawers.

9. The medical treatment cart as defined in claim 2 including means for partitioning at least one of each of said first and second plurality of drawers into a pair of drawer compartments.

10. The medical treatment cart as defined in claim 2 including means for partitioning at least one of each of said first and second plurality of drawers into a pair of drawer compartments, and at least one of said plurality of individual supply containers in one of the pair of drawer compartments.

11. The medical treatment cart as defined in claim 5 including means for partitioning at least one of each of said first and second plurality of drawers into a pair of drawer compartments.

12. The medical treatment cart as defined in claim 6 including means for partitioning at least one of each of said first and second plurality of drawers into a pair of drawer compartments.

13. The medical treatment cart as defined in claim 7 including means for partitioning at least one of each of said first and second plurality of drawers into a pair of drawer compartments.

14. The medical treatment cart as defined in claim 8 including means for partitioning at least one of each of said first and second plurality of drawers into a pair of drawer compartments.

15. The medical treatment cart as defined in claim 8 wherein each supply container includes means for effecting the identification of a specific patient.

16. The medical treatment cart as defined in claim 8 wherein each supply container includes means for effecting the identification of a specific patient, and said identification effecting means is located on each supply container at a position readily observable over an associated short front wall of a drawer within which the supply container is housed.

17. The medical treatment cart as defined in claim 15 including means for partitioning at least one of each of said first and second plurality of drawers into a pair of drawer compartments.

18. The medical treatment cart as defined in claim 16 including means for partitioning at least one of each of said first and second plurality of drawers into a pair of drawer compartments.

* * * * *